US008754368B2

(12) United States Patent
Taniguchi

(10) Patent No.: US 8,754,368 B2
(45) Date of Patent: Jun. 17, 2014

(54) MASS SPECTROMETER

(75) Inventor: Junichi Taniguchi, Kyoto (JP)

(73) Assignee: Shimadzu Corporation, Kyoto-Shi (JP)

( * ) Notice: Subject to any disclaimer, the term of this patent is extended or adjusted under 35 U.S.C. 154(b) by 45 days.

(21) Appl. No.: 12/999,957

(22) PCT Filed: Jun. 20, 2008

(86) PCT No.: PCT/JP2008/001602
§ 371 (c)(1),
(2), (4) Date: Jan. 10, 2011

(87) PCT Pub. No.: WO2009/153841
PCT Pub. Date: Dec. 23, 2009

(65) Prior Publication Data

US 2011/0095180 A1 Apr. 28, 2011

(51) Int. Cl.
*H01J 49/40* (2006.01)
*H01J 49/36* (2006.01)
*H01J 49/42* (2006.01)

(52) U.S. Cl.
CPC ..... *H01J 49/36* (2013.01); *H01J 49/40* (2013.01); *H01J 49/424* (2013.01); *H01J 49/426* (2013.01); *H01J 49/427* (2013.01)
USPC ..... 250/287; 250/281; 250/282; 250/283

(58) Field of Classification Search
CPC ..... H01J 49/26; H01J 49/34; H01J 49/36; H01J 49/40; H01J 49/424; H01J 49/426; H01J 49/4265; H01J 49/427
USPC ..... 250/281, 282, 283, 287, 288
See application file for complete search history.

(56) References Cited

U.S. PATENT DOCUMENTS

2004/0061050 A1 4/2004 Kato
2004/0079875 A1* 4/2004 Ding ..... 250/282
(Continued)

FOREIGN PATENT DOCUMENTS

JP 2001210269 A 8/2001
JP 2004-206933 A 7/2004
(Continued)

OTHER PUBLICATIONS

Japanese language international preliminary report on patentability dated Feb. 8, 2011 and its English language translation for corresponding PCT application PCT/JP2008/001602.
Japanese language office action dated Aug. 7, 2012 and its English language translation issued in corresponding Japanese application 2010517557.
(Continued)

*Primary Examiner* — Nicole Ippolito
(74) *Attorney, Agent, or Firm* — Bingham McCutchen LLP

(57) ABSTRACT

In performing an isolation of specific ions or performing a dissociation operation by CID, ions are captured by applying a radio-frequency high voltage to a ring electrode 31 as before. In a cooling operation which is performed immediately before target ions are ejected toward a TOFMS unit 4 with the ions stored in an ion trap 3, a radio-frequency high voltage is not applied to the ring electrode 31 but to end cap electrodes 32 and 34 to capture the ions. In this operation, the frequency thereof is set to be higher than that of the voltage applied to the ring electrode 31 and the amplitude is also increased in order to assure a large pseudopotential and keep the low mass cutoff (LMC). This narrows the spatial distribution of the cooled ions, reducing the variation of the initial positions of the ions at the point in time when they are ejected, which increases the mass resolution. In addition, since an isolation of ions having a large m/z can be performed with a great $q_z$ value as is conventionally done, a high mass selectivity can be assured.

13 Claims, 2 Drawing Sheets

(56) References Cited

U.S. PATENT DOCUMENTS

| | | | | |
|---|---|---|---|---|
| 2004/0119015 | A1 | 6/2004 | Hashimoto et al. | |
| 2004/0132083 | A1 | 7/2004 | Kawato et al. | |
| 2008/0191130 | A1 * | 8/2008 | Bateman et al. | 250/283 |

FOREIGN PATENT DOCUMENTS

| | | | |
|---|---|---|---|
| JP | 2004-214077 | A | 7/2004 |
| JP | 2008-091199 | A | 4/2008 |
| WO | WO-2006008537 | A2 | 1/2006 |

OTHER PUBLICATIONS

Chinese language office action dated Aug. 13, 2012 and its English language translation issued in corresponding Chinese application 200880129936.7 cites the U.S. patent application publication above.

Chinese Office Action dated Mar. 5, 2013 for corresponding Chinese Patent Application No. 200880129936.7, English translation of Reason for Rejection.

Supplemental European Search Report for European Patent Application No. EP 08764185, completed Oct. 11, 2013 and mailed Oct. 23, 2013.

* cited by examiner

MASS SPECTROMETER

CROSS-REFERENCE TO THE RELATED APPLICATIONS

This application is a national stage of international application No. PCT/JP2008/001602 filed on Jun. 20, 2008, the entire contents of which are incorporated herein by reference.

TECHNICAL FIELD

The present invention relates to a mass spectrometer having an ion trap for capturing and storing ions by an electric field, and a time-of-flight mass spectrometer (TOFMS) unit for separating and detecting ions in accordance with their m/z which are ejected from the ion trap.

BACKGROUND ART

As a kind of mass spectrometer, an ion trap time-of-flight mass spectrometer (IT-TOFMS) is commonly known. In this type of mass spectrometer, a variety of ions generated in an ion source are temporarily captured in an ion trap (IT) and then ejected from the ion trap to be collectively introduced into a time-of-flight mass spectrometer unit. A mass spectrometer of this kind can perform a mass analysis in the following manner: a variety of ions are first stored in the ion trap and only ions having a specific m/z or ions included in a specific m/z range are selectively left in the ion trap; the remaining ions are dissociated as precursor ions by a collision-induced dissociation (CID) method or other method; and product ions generated by the dissociation are ejected from the ion trap to be mass analyzed.

As the aforementioned ion trap, a three-dimensional quadrupole type is widely used, which has a circular ring electrode 31 and a pair of end cap electrodes 32 and 34 placed in such a manner as to face each other across the ring electrode 31 as illustrated in FIG. 3(*a*), although a linear type configuration is also known in which a plurality of rod electrodes are arranged in parallel. Hereinafter, an "ion trap" indicates the aforementioned three-dimensional quadrupole ion trap.

The ion trap 3 is basically configured so that the end cap electrodes 32 and 34 are set at the ground potential for example and a radio-frequency high voltage whose amplitude can be changed is applied to the ring electrode 31, in order to form quadrupole electric field in the space surrounded by these electrodes. Ions are trapped by the action of the electric field. In an example of the configuration for applying the radio-frequency high voltage to the ring electrode, a coil is connected to the ring electrode, and an LC resonance circuit is formed with the inductance of the coil, the capacitances between the ring electrode and two end cap electrodes, and the capacitance of all the other circuit elements connected to the ring electrode. To this LC resonance circuit, a radio-frequency driving source (RF excitation circuit) for driving it is connected directly or via a transformer coupling. In this configuration, the amplitude can be increased by using a large Q value so that a large-amplitude radio-frequency voltage will be applied to the ring electrode even with a small drive voltage (for example, refer to Patent Document 1).

It is known that applying a radio-frequency high voltage to the ring electrode 31 as previously described forms a pseudopotential having a shape as shown in FIG. 3(*b*) inside the ion trap 3 (refer to Non-Patent Document 1). Ions are captured while oscillating in the potential well where the pseudopotential is low. In theory, the depth of the potential well is approximated by equations (1) and (2):

$$D_z=(V/8)\cdot q_z \tag{1}$$

$$q_z=8\cdot z\cdot e\cdot V/m\cdot(r_0^2+2\cdot z_0^2)\cdot\Omega^2 \tag{2}$$

where e is the elementary charge, z is the charge number of the ion, V and Ω are respectively the amplitude and the angular frequency of the radio-frequency high voltage applied to the ring electrode 31, m is the mass of the ion, $r_0$ is the inscribed radius of the ring electrode 31, and $z_0$ is the shortest distance from the center point of the ion trap 3 to the end cap electrodes 32 and 34. As is well known, $q_z$ is one of the parameters which indicate the stability conditions of the solution of the Mathieu equations of motion.

In performing an MS/MS or $MS^n$ analysis, ions are stored inside the ion trap 3, and then a small-amplitude radio-frequency voltage is applied between the end cap electrodes 32 and 34 while the ions are captured in the ion trap 3. Thereby, ions having a specific m/z or included in an m/z range in accordance with the frequency of the applied voltage are resonantly excited and expelled from the ion trap 3, That is, a selection (or isolation) of ions is performed. Subsequently, a CID gas is introduced into the ion trap and a small-amplitude radio-frequency voltage is applied between the end cap electrodes 32 and 34 to excite the ions left in the ion trap to make them collide with the CID gas, promoting the dissociation of the ions. In this manner, product ions having smaller m/z are captured and stored in the ion trap 3.

After the target ions are captured in the ion trap 3 in the previously described manner, a direct-current high voltage is applied between the end cap electrodes 32 and 34 to give a kinetic energy to the ions so as to eject the ions from the ion trap 3 into the TOF, where a mass analysis is performed. At the point in time when ions are ejected from the ion trap 3 in this manner, it is preferable to minimize the distribution of the ions at the center of the ion trap 3. This is because the spatial distribution of ions when they are ejected contributes to mass errors. Given this factor, generally, an inert gas such as helium or argon is introduced into the ion trap 3 before the ions are ejected from the ion trap 3 to make the ions collide with the gas molecules to decrease the kinetic energy of the ions. This operation is called a cooling.

The conventional cooling process is similar to the ion-capturing process in that a radio-frequency high voltage is applied to the ring electrode 31 while the end cap electrodes 32 and 34 are set at the ground potential. With this voltage setting, the spatial distribution of ions in the ion trap 3 is dependent on the amplitude of the voltage applied to the ring electrode 31. Because, as is understood from equation (1), the smaller the amplitude V of the radio-frequency high voltage applied to the ring electrode 31 is, the shallower the pseudopotential $D_z$ becomes, which makes the ions stay wide spread. In a reflectron TOF, the initial positional distribution of ions can be corrected when the ions are reversed, but if the initial distribution of the ions is too large, the difference can no longer be corrected and that causes the mass shift.

Hence, in order to increase the mass resolution and alleviate the mass shift in an IT-TOFMS, it is preferable to increase the pseudopotential $D_z$ which is expressed by equation (1) as much as possible in the cooling operation before the ions are ejected. Since the pseudopotential $D_z$ is proportional to the square of the amplitude V of the radio-frequency high voltage applied to the ring electrode 31, increasing the amplitude V increases the pseudopotential $D_z$. However, as is understood from equation (2), increasing the amplitude V also increases the $q_z$ value. From the aforementioned theory based on the stability conditions of the solution of the Mathieu equations, it is known that the $q_z$ value is required to be equal to or less than 0.908 to capture ions in the ion trap 3. If the amplitude V is simply increased, the $q_z$ value particularly for a small mass m might exceed 0.908. In other words, increasing the pseudopotential $D_z$ in order to enhance the convergence of ions in a cooling operation increases the smallest capturable mass (or low mass cutoff: LMC), which possibly leads to the result that ions in a lower m/z range cannot be captured.

Therefore, one possible method for increasing the pseudopotential $D_z$ while maintaining the $q_z$ value so as to keep the LMC at low levels, is to increase the frequency Ω of the radio-frequency high voltage applied to the ring electrode 31 and also increase the amplitude V thereof in proportion to the square of the frequency Ω, rather than increasing solely the amplitude V. Meanwhile, as is clear from equation (2), maintaining the same $q_z$ value when the frequency Ω is doubled requires quadrupling the amplitude V. To enhance the mass selectivity in isolating ions, it is preferable that the $q_z$ value be large. In this case, if the m/z of the ions to be isolated is large, the amplitude V is required to be considerably increased. For example, an amplitude of 6.2 [kV] is enough to isolate ions of m/z3000 at the operating point of $q_z$=0.81 under the conditions of $r_0$=10 [mm], $z_0$=7 [mm], and a frequency of 500 [kHz]. However, if the frequency is doubled to 1 [MHz], the amplitude V is required to be quadrupled to 24 [kV]. Hence, increasing the voltage applied to the ring electrode 31 is practically impossible due to the problems of electric discharges between the electrodes, the limitation of the driving capability of the LC resonance circuit, and other factors.

[Patent Document 1] Japanese Unexamined Patent Application Publication No. 2004-214077

[Non-Patent Document 1] Junichi Taniguchi and Eizoh Kawatoh, "Development of High-Performance Liquid Chromatograph/IT-TOF Mass Spectrometer," BUNSEKI KAGAKU, The Japan Society for Analytical Chemistry, vol. 57, No. 1, pp. 1-13, Jan. 5, 2008.

DISCLOSURE OF THE INVENTION

Problem to be Solved by the Invention

Consequently, increasing both the frequency and the amplitude of the radio-frequency high voltage applied to the ring electrode 31 is not desirable for keeping a good mass selectivity in isolating ions. At the same time, in order to increase the mass resolution and alleviate the mass shift in an IT-TOFMS, it is necessary to enhance the convergence of ions in a cooling operation before the ions are ejected from the ion trap, which requires an increase in the pseudopotential.

The present invention has been developed to solve the aforementioned problem and the objective thereof is to provide an ion trap time-of-flight mass spectrometer capable of enhancing the mass resolution and alleviating the mass shift in an analysis by a TOF by deepening the pseudopotential inside the ion trap in performing a cooling to increase the spatial convergence of ions immediately before ejecting the ions from the ion trap.

Means for Solving the Problem

To solve the previously described problem, the present invention provides a mass spectrometer having: an ion trap composed of a ring electrode and a pair of end cap electrodes; and a time-of-flight mass spectrometer unit for mass analyzing ions ejected from the ion trap, the mass spectrometer comprising:

a) a voltage applier for selectively applying a radio-frequency high voltage and a direct-current voltage to the end cap electrodes;

b) a gas introducer for introducing a cooling gas into the ion trap; and c) a controller for conducting a cooling of ions by introducing a cooling gas into the ion trap by the gas introducer while ions to be analyzed are captured in the ion trap and applying the radio-frequency high voltage to the end cap electrodes by the voltage applier, and then for applying the direct-current voltage to the end cap electrodes by the voltage applier to give a kinetic energy to the ions to eject the ions from the ion trap.

That is, in conventional ion traps, a radio-frequency high voltage is applied to the ring electrode in a cooling operation to form a pseudopotential for capturing ions; whereas in this invention, a radio-frequency high voltage is applied to the end cap electrodes in a cooling operation to form a pseudopotential. In performing an isolation in which ions having a specific m/z or ions in a specific m/z range are left in the ion trap, the radio-frequency high voltage is applied to the ring electrode, as is conventionally done. Conventional ion traps also apply a radio-frequency (alternating-current) voltage between end cap electrodes. However, as previously described, this is aimed at resonantly exciting ions having a specific m/z or ions included in a specific m/z range to perform an isolation of the ions or a CID, and the amplitude thereof is 10 [V] at the most. On the other hand, in the mass spectrometer according to the present invention, a radio-frequency high voltage with an amplitude of equal to or more than 100 [V] can be selectively applied to the end cap electrodes.

The frequency of the radio-frequency high voltage applied to the end cap electrodes can be determined independently of the radio-frequency high voltage applied to the ring electrode in an isolation operation or other operations. Preferably, the frequency of the radio-frequency high voltage applied to the end cap electrodes may be set to be higher than that of the radio-frequency high voltage applied to the ring electrode, Of course, increasing the pseudopotential while keeping the $q_z$ which is specified by equation (2) requires increasing the amplitude of the radio-frequency high voltage as the frequency thereof is increased. This enables a large pseudopotential to be formed in the ion trap in a cooling operation, and thereby ions can be efficiently gathered into the central region of the ion trap. This decreases the variation of the initial positions of ions when a direct-current high voltage is applied to the end cap electrodes and the ions are ejected, enhancing the mass resolution as well as alleviating the mass shift. In addition, since the conditions for stably capturing ions particularly of small m/z is also satisfied, ions of small m/z can be assuredly captured and cooled in the ion trap.

Effects of the Invention

With the mass spectrometer according to the present invention, the pseudopotential in a cooling operation before the ejection of ions can be increased to enhance the convergence of the ions while keeping a mass selectivity as good as before in performing, for example, an isolation of specific ions so as to leave precursor ions for an $MS^n$ analysis in the ion trap. This decreases the variation of the initial positions of ions when the ions are introduced into the time-of-flight mass spectrometer unit, enhancing the mass resolution of a mass analysis as well as alleviating the mass shift.

EXPLANATION OF NUMERALS

1 . . . Ionization Unit
2 . . . Ion Guide
3 . . . Ion Trap
31 . . . Ring Electrode
32, 34 . . . End Cap Electrode
33 . . . Ion Inlet
35 . . . Ion Outlet
4 . . . Time-Of-Flight Mass Spectrometer (TOFMS) Unit
41 . . . Flight Space
42 . . . Reflectron Electrode
43 . . . Ion Detector
5 . . . Ring Voltage Generator
51 . . . Radio-Frequency High Voltage Generator
6 . . . End Cap Voltage Generator
61 . . . Direct-Current Voltage Generator
62 . . . Radio-Frequency Low Voltage Generator
63 . . . Radio-Frequency High Voltage Generator
64 . . . Voltage Change Unit
7 . . . Gas Introducer
8 . . . Controller
9 . . . Operation Unit

BEST MODE FOR CARRYING OUT THE INVENTION

Figure 1:
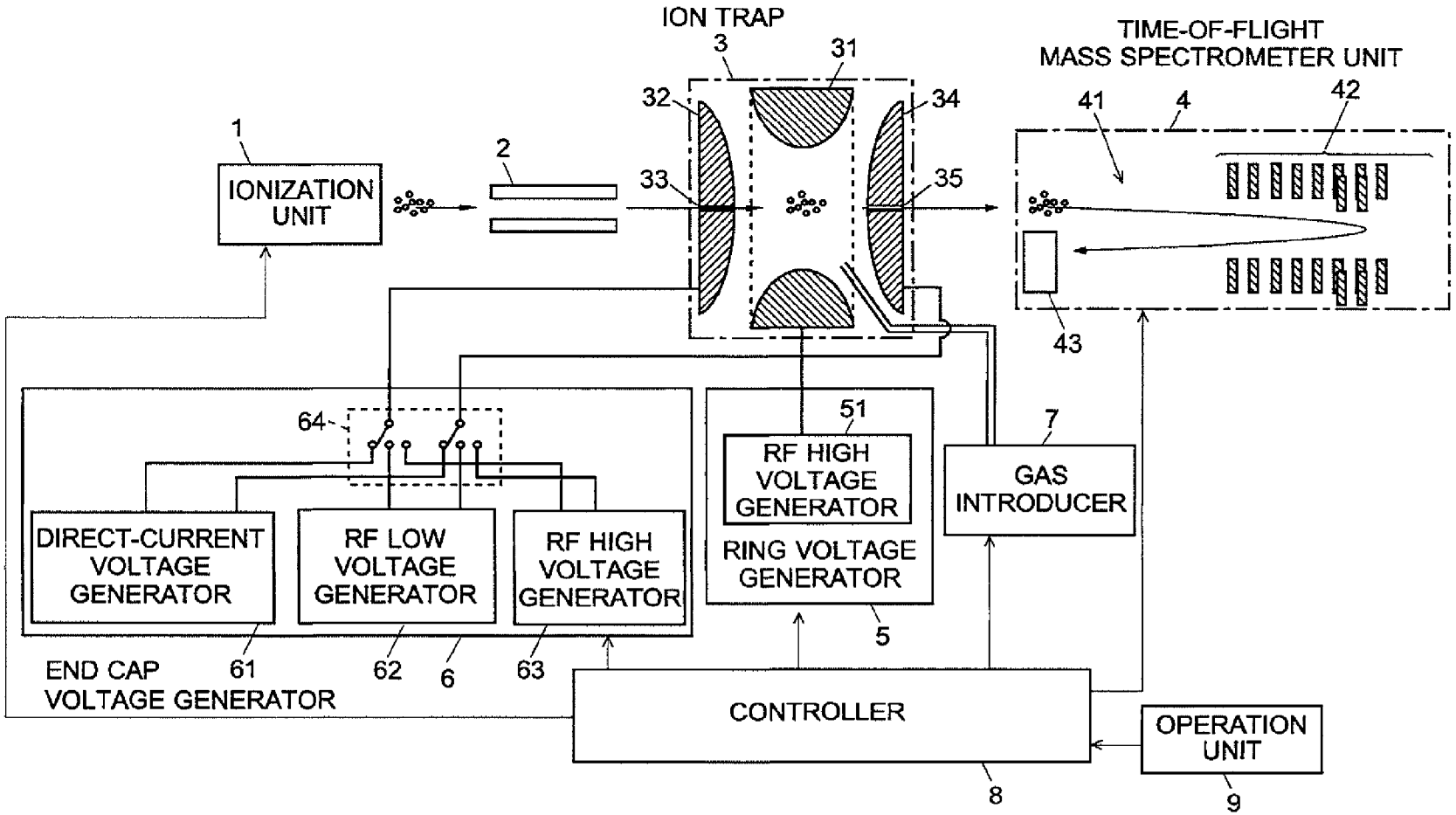
FIG. 1 is an entire configuration diagram of the IT-TOFMS according to an embodiment of the present invention.

An IT-TOFMS according to an embodiment of the present invention will be described with reference to the figures. FIG. 1 is a configuration diagram showing the main components of the IT-TOFMS of the present embodiment.

In FIG. 1, inside a vacuum chamber (which is not indicated), an ionization unit 1, an ion guide 2, an ion trap 3, and a time-of-flight mass spectrometer (TOFMS) unit 4 are placed. The ionization unit 1 can ionize a sample component by using a variety of ionization methods such as: an atmospheric ionization method, e.g. an electrospray ionization method, for a liquid sample; an electron ionization method, a chemical ionization method, or other method, for a gaseous sample; and a laser ionization method or other method, for a solid sample.

Figure 3:
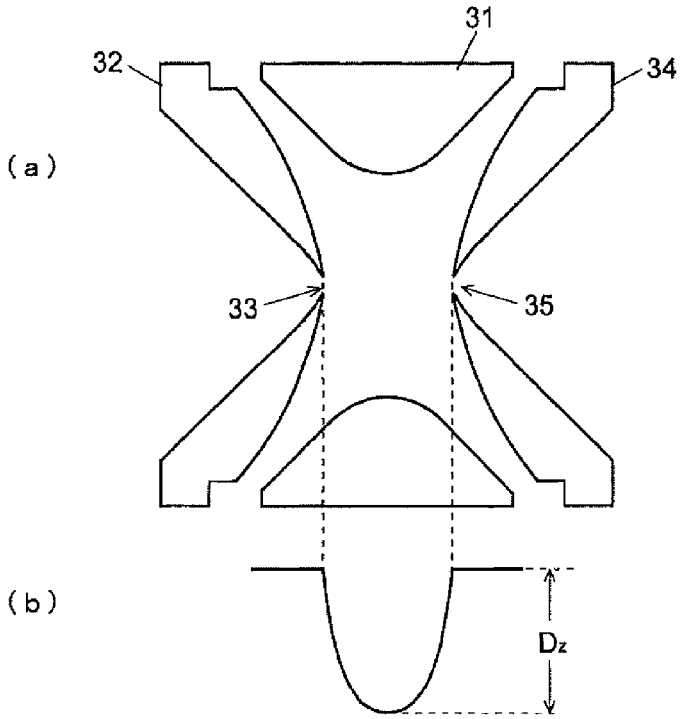
FIG. 3 is a diagram illustrating a schematic configuration and a pseudopotential shape in a general three-dimensional quadrupole ion trap.

The ion trap 3 is, as in FIG. 3(*a*), a three-dimensional quadrupole ion trap composed of a circular ring electrode 31 and a pair of end cap electrodes 32 and 34 opposing each other with the ring electrode 31 therebetween. An ion inlet 33 is bored approximately at the center of the entrance-side end cap electrode 32, and an ion outlet 26 is bored approximately at the center of the exit-side end cap electrode 34 in substantial alignment with the ion inlet 33.

The TOFMS unit 4 has a flight space 41 including a reflectron electrode 42 and an ion detector 43. The travel direction of the ions is reversed by the electric field formed by the voltage applied to the reflection electrode 42 by a direct-current voltage generator (not shown), and the ions reach the ion detector 43 to be detected.

A ring voltage generator 5 is connected to the ring electrode 31, and an end cap voltage generator 6 is connected to the end cap electrodes 32 and 34. The ring voltage generator 5 includes a radio-frequency (RF) high voltage generator 51 which uses an LC resonance circuit disclosed by Patent Document 1 for example. The end cap voltage generator 6 includes a direct-current voltage generator 61, a radio-frequency low voltage generator 62, and a radio-frequency high voltage generator 63 which has the same configuration as the radio-frequency high voltage generator 51 included in the ring voltage generator 5. One of these voltages is selected by a voltage change unit 64 and applied to the end cap electrodes 32 and 34. The amplitude of the radio-frequency voltage generated in the radio-frequency high voltage generator 63 is not less than 100 [V] and can be as high as on the order of kV, whereas the amplitude of the radio-frequency voltage generated in the radio-frequency low voltage generator 62 is far smaller than that and is at most approximately 10 [V]. The direct-current voltage generator 61 and the radio-frequency low voltage generator 62 are included in conventional IT-TOFMSs. However, the radio-frequency high voltage generator 63 is not included in conventional IT-TOFMSs.

A cooling gas or a CID gas is selectively introduced into the ion trap 3 from a gas introducer 7 which includes a valve and other elements. As a cooling gas, an inert gas is generally used such as helium, argon, or nitrogen, which is stable and neither ionized nor dissociated after colliding with ions to be measured.

The operation of the ionization unit 1, the TOFMS unit 4, the ring voltage generator 5, the end cap voltage generator 6, the gas introducer 7, and other components is controlled by a controller 8 configured mainly with a central processing unit (CPU). An operation unit 9 for setting analysis conditions and other parameters is attached to the controller 8.

Figure 2:
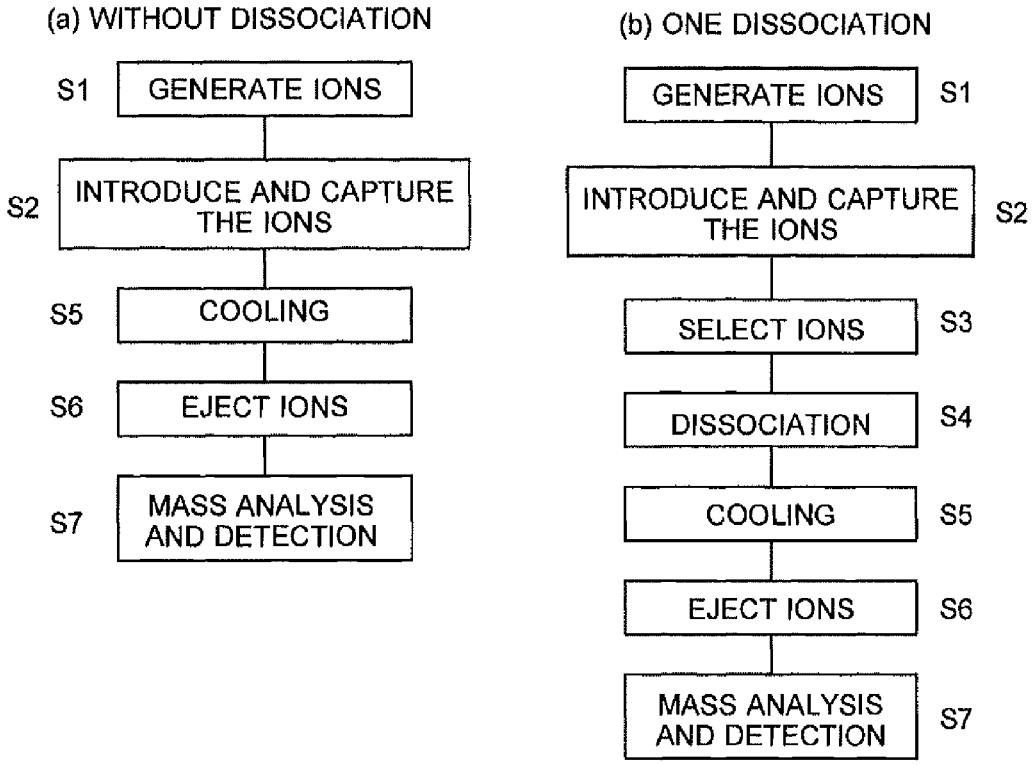
FIG. 2 is a flowchart illustrating an example of the procedure of a mass analysis by the IT-TOFMS of the present embodiment.

FIG. 2 is a flowchart illustrating the analysis procedure using the IT-TOFMS of the present embodiment. FIG. 2(*a*) is a flowchart for the case where no dissociation operation is performed, and FIG. 2(*b*) is that for the case where one dissociation operation, i.e. an MS/MS analysis, is performed. The basic operation of the mass spectrometer of the present embodiment will be described with reference to these flowcharts.

First, an MS analysis operation in which no dissociation operation is performed is described. The ionization unit 1 ionizes component molecules or atoms of a target sample by a predetermined ionization method (Step S1). The generated ions are transported by the ion guide 2, introduced into the ion trap 3 through the ion inlet 33, and captured inside thereof (Step S2). In general, when ions are introduced into the ion trap 3, the direct-current voltage generator 61 and the end cap electrodes 32 and 34 are connected by the voltage change unit 64. Thereby, a direct-current voltage which acts in such a manner as to draw ions sent from the ion guide 2 is applied to the entrance-side end cap electrode 32 and a direct-current voltage which acts in such a manner as to repel ions which have entered the ion trap 3 is applied to the exit-side end cap electrode 34.

In the case where the ionization unit 1 generates ions in a pulsed fashion as a MALDI, the radio-frequency high voltage is applied to the ring electrode 31 immediately after an incoming packet of ions is received into the ion trap 3 to capture the ions. In the case where the ionization unit 1 almost continuously generates ions as an atmospheric pressure ionization method, a coating of resistive material may be formed on a portion of the rod electrodes of the ion guide 2 to form a depression of the potential at the end part of the ion guide 2. Ions may be temporarily stored in the depression, then compressed in a short time, and introduced into the ion trap 3 (for example, refer to pp. 3-5 of Non-Patent Document 1). The radio-frequency high voltage applied to the ring electrode 31 has a frequency of 500 [kHz] and an amplitude of 100 [V]

through a few [kV] for example. This amplitude is appropriately determined in accordance with the range of the m/z of the ions to be captured.

After the ions are stored in the ion trap 3, a cooling gas is introduced into the ion trap 3 from the gas introducer 7. Then, as will be described later, the radio-frequency high voltage is now applied to the end cap electrodes 32 and 34 to form a quadrupole electric field. While being captured by the quadrupole electric field, the ions are cooled (Step S5). After the cooling is performed for a predetermined period of time, the direct-current high voltage is applied between the end cap electrodes 32 and 34 to give the ions an initial acceleration energy, so that the ions exit through the ion outlet 35 and are introduced into the TOFMS unit 4 (Step S6). If ions are accelerated by the same acceleration voltage, ions having a smaller m/z have a larger velocity, and thus fly faster to arrive at the ion detector 43 sooner to be detected (Step S7). By recording the detection signal from the ion detector 43 as time progresses from the point in time when ions are ejected from the ion trap 3, a flight time spectrum can be obtained which shows the relationship between the flight time and the ion intensity. Since the flight time corresponds to the m/z of an ion, a mass spectrum is created by converting the flight time into the m/z.

Next, the operation in performing an MS/MS analysis is described. In this case, the operations of Steps S3 and S4 are performed between Steps S2 and S5. That is, after a variety of ions having various m/z are captured in the ion trap 3, the setting of the voltage change unit 64 is changed to connect the radio-frequency low voltage generator 62 and the end cap electrodes 32 and 34. Then, a small-amplitude radio-frequency voltage having a frequency component which has a notch at the frequency corresponding to the m/z of the ions to be left as precursor ions is applied between the end cap electrodes 32 and 34. This excites the ions having m/z other than the m/z corresponding to the notch frequency, so that they oscillate significantly enough to be ejected from the ion inlet 33 and the ion outlet 35 or annihilated by colliding with the inner surface of the end cap electrodes 32 and 34. In this manner, the ions having a specific m/z are selectively left in the ion trap 3 (Step S3). At this point in time, the radio-frequency high voltage is still applied to the ring electrode 31.

After that, a CID gas is introduced into the ion trap 3 from the gas introducer 7, and a small-amplitude radio-frequency voltage having a frequency corresponding to the m/z of the precursor ions is applied between the end cap electrodes 32 and 34. Consequently, the precursor ions to which a kinetic energy has been given are excited and collide with the CID gas, being dissociated to generate product ions (Step S4). Since the product ions generated in this manner have a smaller m/z than that of the original precursor ions, the amplitude of the radio-frequency high voltage applied to the ring electrode 31 is determined in such a manner as to capture also such ions having small m/z. After being cooled in Step S5, the captured product ions are ejected from the ion trap 3 and mass analyzed.

In the case where an $MS^n$ analysis is performed in which two or more ion selections and dissociation operations are performed, the operations of Steps S3 and S4 in FIG. 2(*b*) can be repeated plural times.

Next, the operation characteristic of the IT-TOFMS of the present embodiment is described. In the conventional cases, the cooling operation in Step S5 is performed in a manner similar to the ion capturing process in Step S2 and the ion selection process in Step S3; that is to say, a radio-frequency high voltage is applied to the ring electrode 31 to capture the ions. On the other hand, in the IT-TOFMS of this embodiment, a radio-frequency high voltage is not applied to the ring electrode 31 but to the end cap electrodes 32 and 34, and thereby a quadrupole electric field for capturing is generated in the ion trap 3. At this point in time, applying a voltage to the ring electrode 31 is generally halted and the ring electrode 31 is set at the ground potential. Unlike the radio-frequency low voltages applied to the end cap electrodes 32 and 34 to excite ions, the radio-frequency high voltages applied to the end cap electrodes 32 and 34 at this stage have the same phase.

Although the frequency of the radio-frequency high voltage applied to the end cap electrodes 32 and 34 can be appropriately determined, it may be higher than that of the radio-frequency high voltage applied to the ring electrode 31, e.g. 1 [MHz], twice as high as that. Equation (2) shows that, in order to keep the same $q_z$ value, the amplitude is required to be quadrupled when the frequency is doubled. For example, in order to set the low mass cutoff (LMC) to be 200, the amplitude of the radio-frequency high voltage can be set to be approximately 400 [V] when the frequency thereof is 500 [kHz]. If the frequency of the radio-frequency high voltage is doubled to 1 [MHz], the frequency is required to be quadrupled to approximately 1.6 [kV]. Meanwhile, as is clear from equation (1), the pseudopotential is more sensitive to an increase of the amplitude than the $q_z$ value: if the frequency is doubled and the amplitude is quadrupled, the pseudopotential becomes four times greater.

By determining the radio-frequency high voltage applied to the end cap electrodes 32 and 34 in the manner as just described, as the pseudopotential increases, the ions which have lost a kinetic energy due to the collision with the cooling gas gather more easily at the center of the ion trap 3. That is, the spatial distribution of ions becomes narrow, which decreases the variation of the initial positions of ions when the flight of the ions is started by giving them a kinetic energy in the next step by applying a direct-current high voltage between the end cap electrodes 32 and 34. As a consequence, the mass resolution of the mass analysis performed in the TOFMS unit 4 is increased, and the mass shift can be suppressed at the same time.

It should be noted that the embodiment described thus far is an example of the present invention, and it is a matter of fact that any modification, addition, or adjustment made within the spirit of the present invention is also included in the scope of the claims of the present application.

The invention claimed is:

1. A mass spectrometer comprising:

an ion trap having a ring electrode and a pair of end cap electrodes opposing each other with the ring electrode disposed therebetween;

a time-of-flight mass spectrometer unit for mass analyzing ions ejected from the ion trap;

a ring voltage applier for applying an ion-capturing radio-frequency high voltage to the ring electrode;

an end cap voltage applier for selectively applying a radio-frequency high voltage having an amplitude of 100V or more, or a direct-current voltage to the end cap electrodes;

a gas introducer for introducing a cooling gas into the ion trap; and a controller, wherein the controller controls the ring voltage applier to apply the ion-capturing radio-frequency high voltage to the ring electrode to trap ions, conducts a cooling of ions by introducing a cooling gas into the ion trap by the gas introducer while ions to be analyzed are captured in the ion trap, halts an application of the ion-capturing radio-frequency high voltage to the ring electrode by the ring voltage applier, sets the ring electrode at a ground potential, applies the radio-frequency high voltage having the amplitude of 100V or more to the pair of the end cap electrodes, both having the same phase, by the end cap voltage applier and applies the direct current voltage to the end cap electrodes by the end cap voltage applier to give a kinetic energy to the ions to eject the ions from the ion trap.

2. The mass spectrometer according to claim 1, wherein a frequency of the radio-frequency high voltage applied to the end cap electrodes by the end cap voltage applier in performing the cooling of the ions is set to be higher than a frequency of the ion-capturing radio-frequency high voltage applied by the ring voltage applier.

3. The mass spectrometer according to claim 1, wherein the end cap voltage applier includes a radio-frequency high voltage generator for generating the radio-frequency high voltage, a radio-frequency low voltage generator for generating a radio-frequency low voltage, and a direct-current voltage generator for generating the direct current.

4. The mass spectrometer according to claim 1, wherein the end cap voltage applier includes a radio-frequency high voltage generator for generating the radio-frequency high voltage, a radio-frequency low voltage generator for generating a radio-frequency low voltage, a direct-current voltage generator for generating the direct current, and a voltage change unit for selectively connecting to the radio-frequency high voltage generator, the radio-frequency low voltage generator, or the direct-current voltage generator.

5. The mass spectrometer according to claim 1, wherein after the controller controls the ring voltage applier to apply the ion-capturing radio-frequency high voltage to the ring electrode to trap the ions but before the controller halts an application of the ion-capturing radio-frequency high voltage to the ring electrode by the ring voltage applier, the controller further controls the end cap voltage applier to apply a radio-frequency low voltage to the end cap electrodes while the ion-capturing radio-frequency high voltage is applied to the ring electrode in such a way that the frequency component of the radio-frequency low voltage has a notch at a frequency corresponding to the m/z of ions to be left in the ion trap as precursors.

6. A mass spectrometry method comprising:

providing an ion trap comprising a ring electrode and a pair of end cap electrodes opposing each other with the ring electrode disposed therebetween;

providing a time-of-flight mass spectrometer unit for mass analyzing ions ejected from the ion trap;

providing a ring voltage applier for applying an ion-capturing radio-frequency high voltage to the ring electrode;

providing an end cap voltage applier for selectively applying a radio-frequency high voltage having an amplitude of 100V or more, or a direct-current voltage to the end cap electrodes;

introducing a cooling gas into the ion trap while ions to be analyzed are captured in the ion trap by applying the ion-capturing radio-frequency high voltage to the ring electrode by the ring voltage applier;

halting an application of the ion-capturing radio-frequency high voltage to the ring electrode by the ring voltage applier;

setting the ring electrode at a ground potential; and applying the radio-frequency high voltage having the amplitude of 100V or more to the pair of the end cap electrodes, both having the same phase, by the end cap voltage applier; and applying the direct-current voltage to the end cap electrodes by the end cap voltage applier to give a kinetic energy to the ions to eject the ions from the ion trap.

7. The mass spectrometer according to claim 6, wherein a frequency of the radio-frequency high voltage applied to the end cap electrodes by the end cap voltage applier in performing the cooling of the ions is set to be higher than a frequency of the ion-capturing radio-frequency high voltage applied by the ring voltage applier.

8. The mass spectroscopy method according to claim 6, further comprising:

after introducing a cooling gas into the ion trap while ions to be analyzed are captured in the ion trap by applying the ion-capturing radio-frequency high voltage to the ring electrode by the ring voltage applier but before halting an application of the ion-capturing radio-frequency high voltage to the ring electrode by the ring voltage applier, applying a radio-frequency low voltage to the end cap electrodes while the ion-capturing radio-frequency high voltage is applied to the ring electrode in such a way that the frequency component of the radio-frequency low voltage has a notch at a frequency corresponding to the m/z of ions to be left in the ion trap as precursors.

9. A mass spectrometer comprising:

an ion trap having a ring electrode and a pair of end cap electrodes opposing each other with the ring electrode disposed therebetween;

a time-of-flight mass spectrometer unit for mass analyzing ions ejected from the ion trap;

a ring voltage applier for applying an ion-capturing radio-frequency high voltage to the ring electrode;

an end cap voltage applier for selectively applying a radio-frequency high voltage having an amplitude of 100V or more, or a direct-current voltage to the end cap electrodes;

a gas introducer for introducing a cooling gas into the ion trap, wherein the ring voltage applier applies the ion-capturing radio-frequency high voltage to the ring electrode to trap ions; the gas introducer introduces the cooling gas into the ion trap while ions to be analyzed are captured in the ion trap; and the ring voltage applier then halts the application of the ion-capturing radio-frequency high voltage to the ring electrode and the ring electrode is set at a ground potential, while approximately at the same time the end cap voltage applier applies the radio-frequency high voltage having the amplitude of 100 V or more to the pair of the end cap electrodes, both having the same phase.

10. The mass spectrometer according to claim 9, wherein the end cap voltage applier applies the direct current voltage to the end cap electrodes to give a kinetic energy to the ions to eject the ions from the ion trap.

11. The mass spectrometer according to claim 9, wherein the end cap voltage applier includes a radio-frequency high voltage generator for generating the radio-frequency high voltage, a radio-frequency low voltage generator for generating a radio-frequency low voltage, and a direct-current voltage generator for generating the direct current.

12. The mass spectrometer according to claim 9, wherein the end cap voltage applier includes a radio-frequency high voltage generator for generating the radio-frequency high voltage, a radio-frequency low voltage generator for generating a radio-frequency low voltage, a direct-current voltage generator for generating the direct current, and a voltage change unit for selectively connecting to the radio-frequency high voltage generator, the radio-frequency low voltage generator, or the direct-current voltage generator.

13. The mass spectrometer according to claim 9, wherein after the ring voltage applier applies the ion-capturing radio-frequency high voltage to the ring electrode to trap ions but before the ring voltage applier halts applying the ion-capturing radio-frequency high voltage to the ring electrode, the end cap voltage applier applies a radio-frequency low voltage to the end cap electrodes while the ion-capturing radio-frequency high voltage is applied to the ring electrode in such a way that the frequency component of the radio-frequency low voltage has a notch at a frequency corresponding to the m/z of ions to be left in the ion trap as precursors.

* * * * *